US005720609A

United States Patent [19]

Pfefferle

[11] Patent Number: 5,720,609

[45] **Date of Patent: *Feb. 24, 1998**

[54] CATALYTIC METHOD

[76] Inventor: William Charles Pfefferle, 51 Woodland Dr., Middletown, N.J. 07748

[ * ] Notice: The term of this patent shall not extend beyond the expiration date of Pat. Nos. 5,453,003 and 5,601,426.

[21] Appl. No.: 764,599

[22] Filed: Dec. 11, 1996

Related U.S. Application Data

[60] Continuation of Ser. No. 480,409, Jun. 7, 1995, Pat. No. 5,601,426, which is a division of Ser. No. 835,556, Feb. 14, 1992, Pat. No. 5,453,003, which is a continuation-in-part of Ser. No. 639,012, Jan. 9, 1991, abandoned.

[51] Int. Cl.[6] ..... F02M 27/02

[52] U.S. Cl. ..... 431/326; 431/7; 431/170

[58] Field of Search ..... 431/7, 170, 326, 431/328, 268; 60/39.225

[56] References Cited

U.S. PATENT DOCUMENTS

| | | | |
|---|---|---|---|
| 4,893,465 | 1/1990 | Farrauto et al. | 60/39.02 |
| 5,051,241 | 9/1991 | Pfefferle | 422/180 |
| 5,453,003 | 9/1995 | Pfefferle | 431/7 |
| 5,601,426 | 2/1997 | Pfefferle | 431/7 |

FOREIGN PATENT DOCUMENTS

| | | | |
|---|---|---|---|
| 0047119 | 3/1982 | Japan | 431/268 |
| 021206 | 12/1982 | Japan | 431/268 |
| 0246512 | 11/1986 | Japan | 431/268 |
| 404015410 | 1/1992 | Japan | 431/268 |

OTHER PUBLICATIONS

"Catalysis in Combustion", Pfefferle et al, pp. 219–267, 1987.

*Primary Examiner*—Carl D. Price

*Attorney, Agent, or Firm*—Kane, Dalsimer, Sullivan, Kurucz, Levy, Eisele and Richard

[57] ABSTRACT

The method of combusting lean fuel-air mixtures comprising the steps of:

a. obtaining an admixture of fuel and air, said admixture having an adiabatic flame above about 900° Kelvin;

b. passing least a portion of said admixture into contact with one or more mesolith combustion catalysts operating at a temperature below the adiabatic flame temperature of said admixture thereby producing reaction products of incomplete combustion; and c. passing said reaction products to a thermal reaction chamber;

thereby igniting and stabilizing combustion in said thermal reaction chamber.

5 Claims, 1 Drawing Sheet

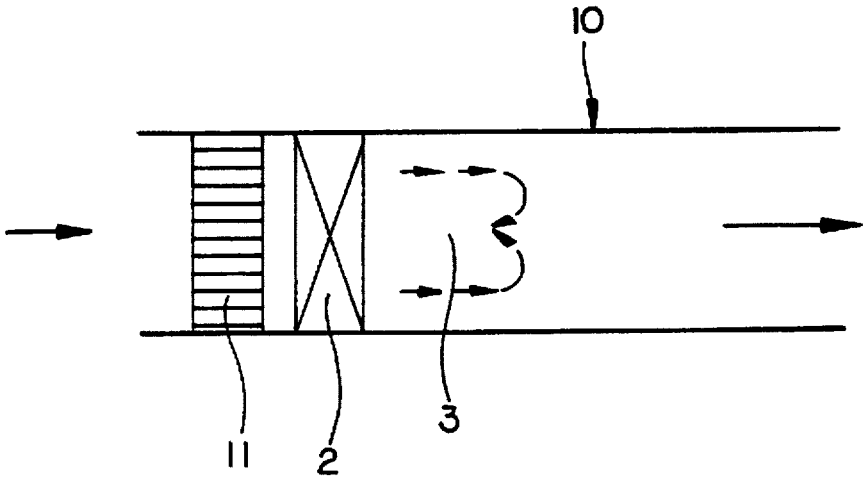
10
11
2
3

CATALYTIC METHOD

This invention is a continuation of U.S. patent application Ser. No. 08/480,409 filed on Jun. 7, 1995 and now U.S. Pat. No. 5,601,246, which is a divisional of U.S. patent application Ser. No. 07/835,556 filed on Feb. 14, 1992 now U.S. Pat. No. 5,453,003, which is a continuation-in-part U.S. patent application Ser. No. 07/639,012 now abandoned.

BACKGROUND OF THE INVENTION

1. Field of the Invention

This invention relates to improved systems for combustion of fuels and to methods for catalytic promotion of fuel combustion. In one specific aspect the present invention relates to catalytic systems for low NOx combustion. In one more specific aspect, this invention relates to low emissions combustors for gas turbine engines.

2. Brief Description of the Prior Art

Unlike gasoline engines which operate with near stoichiometric fuel-air mixtures, gas turbine engines operate with a large excess of air. Thus automotive type catalytic converters cannot be used for control of $NO_x$ emissions since such devices are ineffective in the presence of significant amounts of oxygen. Although selective ammonia denox systems are available, both operating and capital costs are high and energy losses significant. Moreover, such systems are much too large for any but stationary applications.

Consequently, most effort on control of gas turbine emissions has focused on development of low emissions combustors. However, despite much effort resulting in significant improvements, achievement of acceptable emissions levels does not appear feasible using the best conventional combustion systems. The catalytic combustion systems of my U.S. Pat. No. 3,928,961 yield the low required emissions levels. However, because of present materials limitations and the resulting low turndown ratios, few applications have resulted. For gas turbine combustors the requirement is not just low emissions but operability over a wide range of operating conditions. Thus, although emissions can be controlled by use of the catalytic combustors of my prior patent, the current narrow operating temperatures of such combustors, typically limited at present to temperatures between about 1400 and 1700 Kelvin, coupled with the limited durability of available catalysts for methane combustion, has severely limited applications.

The present invention overcomes the limitations of prior art systems and meets the need for reduced emissions from gas turbines and other combustion devices.

SUMMARY OF THE INVENTION

Definition of Terms

In the present invention the terms "monolith" and "monolith catalyst" refer not only to conventional monolithic structures and catalysts such as employed in conventional catalytic converters but also to any equivalent unitary structure such .as an assembly or roll of interlocking sheets or the like.

The terms Microlith™ and Microlith™ catalyst refer to high open area monolith catalyst elements with flow paths so short that reaction rate per unit length per channel is at least fifty percent higher than for the same diameter channel with a fully developed boundary layer in laminar flow, i.e. a flow path of less than about two mm in length, preferably less than one mm or even less than 0.5 mm and having flow channels with a ratio of channel flow length to channel diameter less than about two to one, but preferably less than one to one and more preferably less than about 0.5 to one. Channel diameter is defined as the diameter of the largest circle which will fit within the given flow channel and is preferably less than one mm or more preferably less than 0.5 mm.

For the purposes of the present invention, the term "mesolith" or "mesolith catalyst" means a monolith catalyst with flow channels sufficiently short relative to channel diameter for the given operating conditions that in use for exothermic reactions the catalyst operating temperature is at least 100 degrees Kelvin below the adiabatic flame temperature of the reactant fluid but above the inlet fluid temperature.

The terms "fuel" and "hydrocarbon" as used in the present invention not only refer to organic compounds, including conventional liquid and gaseous fuels, but also to gas streams containing fuel values in the form of compounds such as carbon monoxide, organic compounds or partial oxidation products of carbon containing compounds.

The Invention

As noted in my co-pending application Ser. No. 639,012 it has been found that a catalyst can stabilize gas phase combustion of very lean fuel-air mixtures at flame temperatures as low as 1000 or even below 900 degrees Kelvin, far below not only the minimum flame temperatures of conventional combustion systems but even below the minimum combustion temperatures required for the catalytic combustion method of my earlier systems described in U.S. Pat. No. 3,928,961. In addition, the upper operating temperature is not materials limited since the catalyst can be designed to operate at a safe temperature well below the combustor adiabatic flame temperature.

In the present invention it is taught that catalyst temperature can be maintained at a safe operating temperature by limiting conversion in the catalyst bed such that (1) the temperature of the exiting gases is below such safe operating temperature and (2) the catalyst flow path length is sufficiently short, i.e. typically no more than about half the length for full boundary layer build up, such that the catalyst temperature is at least 100 degrees Kelvin below the reacting gas adiabatic flame temperature and preferably at least 300° lower. The catalysts used are termed "mesoliths". Advantageously, channel flow may be sufficiently turbulent to maintain catalyst temperature closer to the local gas temperature than to the adiabatic flame temperature of the fuel-air mixture.

Thus, the present invention makes possible practical ultra-low emission combustors using available catalysts and catalyst support materials. Equally important, the wide operating temperature range of the method of this invention make possible catalytically stabilized combustors with the large turndown ratio needed for gas turbine engines without the use of variable geometry and often even the need for dilution air to achieve the low turbine inlet temperatures required for idle and low power operation.

In the method of the present invention, a fuel-air mixture is contacted with a mesolith catalyst to produce heat and reactive intermediates for continuous stabilization of combustion in a lean thermal reaction zone at temperatures not only well below a temperature resulting in significant formation of nitrogen oxides from molecular nitrogen and oxygen but often even below the minimum temperatures of prior art catalytic combustors. Combustion of lean fuel-air mixtures has been stabilized in the thermal reaction zone even at temperatures below 1000 Kelvin. Even catalytic surfaces on combustion chamber walls have been found to be effective for ignition of such fuel-air mixtures. The efficient, rapid thermal combustion which occurs in the presence of a catalyst, even with lean fuel-air mixtures outside the normal flammable limits, is believed to result from the injection of heat and free radicals produced by the catalyst surface reactions at a rate sufficient to counter the quenching of free radicals which otherwise minimize thermal reaction even at combustion temperatures much higher than those feasible in the method of the present invention. The catalyst may be in the form of a short channel length mesolith which may be a Microlith™. Advantageously, the thermal reaction zone employ conventional flame holding means to induce recirculation. However, plug flow operation is advantageous in achieving very low emissions of hydrocarbons and carbon monoxide. Typically, plug flow operation is achieved by designing the combustor such that the thermal zone inlet temperature is above the spontaneous ignition temperature of the given fuel, typically less than about 7000 degrees Kelvin for most fuels but around 9000 degrees Kelvin for methane and about 750° Kelvin for ethane.

For combustors, placement of the catalyst at the inlet to the thermal reaction zone allows operation of the catalyst at a temperature below that of the thermal combustion region. Such placement permits operation of the combustor at temperatures well above the temperature of the catalyst as is the case for a combustor wall coated catalyst. Use of electrically heatable catalysts provides both ease of light-off and ready relight in case of a flameout. This also permits use of less costly catalyst materials inasmuch as the lowest possible light-off temperature is not required with an electrically heated catalyst. With typical aviation gas turbines, near instantaneous light-off of combustion is important. This is especially true of auxiliary power units which must be started in flight, typically at high altitude low temperature conditions. Thus use of electrically heatable Microlith™ catalysts are often desirable to minimize power requirements and provide rapid light-off. Typically, the electrically heated catalyst is followed by one or more following short catalyst elements to assure stable combustion in the downstream thermal reaction zone. To further minimize light-off power requirements, only a portion of the inlet flow need be passed through the electrically heated catalyst for reliable ignition of combustion in the thermal reaction zone. With sufficiently high inlet air temperatures, typically at least about 600° Kelvin with most fuels, plug flow operation of the thermal reaction zone is possible even at adiabatic flame temperatures as low as 800° or 900° Kelvin. However, it has been found that at very high flow velocities combustion is more readily stabilized with some degree of backmixing, particularly at lower flame temperatures.

The mass of Microlith™ catalyst elements can be so low that it is feasible to electrically preheat the catalyst to an effective operating temperature in less than about 0.50 seconds. In the catalytic combustor applications of this invention the low thermal mass of Microlith™ catalysts makes it possible to bring an electrically conductive combustor catalyst up to a light-off temperature as high as 1000° or even 1500° Kelvin or more in less than about five seconds, often in less than about one or two seconds with modest power usage. Such rapid heating is allowable for Microlith™ catalysts because sufficiently short flow paths permit rapid heating without destructive stresses from consequent thermal expansion.

In those catalytic combustor applications where unvaporized fuel droplets may be present, flow channel diameter should preferably be large enough to allow unrestricted passage of the largest expected fuel droplet. Therefore in catalytic combustor applications flow channels may be as large as 1.0 millimeters in diameter or more. For combustors, operation With fuel droplets entering the catalyst allows plug flow operation in a downstream thermal combustion zone even at the very low temperatures otherwise achievable only in a well mixed thermal reaction zone.

In one embodiment of the present invention, a fuel-air mixture having an adiabatic flame temperature higher than about 1300° Kelvin and more preferably over 1400° Kelvin is contacted with a mesolith catalyst to produce combustion products, at least a portion of which are mixed with a second fuel-air mixture in a well mixed thermal reaction zone. In this manner the catalytic reactor serves as a torch igniter. Although this system is most advantageously employed to achieve lean low $NO_x$ combustion, the catalyst combustion products advantageously can serve for torch ignition of a conventional combustor thermal reaction zone. Advantageously, at least one catalyst element is electrically heated to its light-off temperature. Further, it is desirable to provide means to provide electrical power during operation to maintain the catalyst at an effective operating temperature as needed.

BRIEF DESCRIPTION OF THE DRAWING

FIG. 1 shows a schematic of a high turn down ratio catalytically induced thermal reaction gas turbine combustor.

DETAILED DESCRIPTION OF THE INVENTION AND PREFERRED EMBODIMENTS

In FIG. 1, fuel and air are passed over electrically heated mesolith catalyst 11 mounted at the inlet of combustor 10 igniting gas phase combustion in thermal reaction zone 3. Swirler 2 induces gas recirculation in thermal reaction zone 3 allowing combustion effluent from catalyst 11 to promote efficient gas phase combustion of very lean prevaporized fuel-air mixtures in reaction zone 3. In the system of FIG. 1, efficient combustion of lean premixed fuel-air mixtures not only can be stabilized at flame temperatures below a temperature which would result in any substantial formation of oxides of nitrogen, but at adiabatic flame temperatures well below a temperature of 1200° Kelvin, and even as low as 900° Kelvin.

EXAMPLE 1

Lean gas phase combustion of Jet-A fuel is stabilized by spraying the fuel into flowing air at a temperature of 750 degrees Kelvin and passing the resulting fuel-air mixture through an electrically heated platinum activated Microlith™ catalyst. The fuel-air mixture is ignited by contact with the catalyst, passed to a plug flow thermal reactor and reacts to produce carbon dioxide and water with release of heat. The catalyst typically operates at a temperature in the range of about 100 Kelvin or more lower than the adiabatic flame temperature of the inlet fuel-air mixture. Efficient combustion is obtained over a range of temperatures as high, as 2000 degrees Kelvin or above and as low as 1100° Kelvin, a turndown ratio higher than existing conventional gas turbine combustors and much higher than catalytic combustors. Premixed fuel and air may be added to the thermal reactor downstream of the catalyst to reduce the flow through the catalyst. If the added fuel-air mixture has an adiabatic flame temperature higher than that of the mixture contacting the catalyst, outlet temperatures at full load much higher than 2000° Kelvin can be obtained with operation of the catalyst maintained at a temperature lower than 1200 degrees Kelvin.

EXAMPLE 2

Lean gas phase combustion of premixed fuel and air is stabilized by passing a fuel-air admixture having an adiabatic flame temperature of 1700 degrees Kelvin through an electrically heated platinum activated mesolith catalyst four millimeters in length followed by a similarly activated passive mesolith catalyst six millimeters in length. The fuel-air mixture is partially reacted catalytically, passed to a backmixed thermal reactor and reacts to produce carbon dioxide and water with release of heat and with negligible formation of nitrogen oxides. The catalyst operates at a temperature of about 1000 degrees Kelvin. Efficient combustion is obtained with fuel air mixtures having adiabatic flame temperatures as low as 1100 degrees Kelvin. Additional premixed fuel and air may be added to the thermal reactor downstream of the catalyst to reduce the size of the catalyst bed needed. If the added fuel-air mixture has an adiabatic flame temperature higher than that of the mixture contacting the catalyst, outlet temperatures at full load much higher than 2000° Kelvin can be obtained with operation of the catalyst maintained at an acceptable temperature.

What is claimed is:

1. A high turndown ratio thermal gas phase combustion system comprising:

a. a thermal reaction chamber, having a fluid inlet and an outlet:

b. catalyst means for continuously stabilizing lean combustion in said chamber, said catalyst means being mounted in the fluid inlet;

c. means for passing a lean admixture of fuel and air into contact with said catalyst means to produce a reacted admixture, said reacted admixture having a temperature at least 100° Kelvin below the adiabatic temperature of said lean admixture of fuel and air, and d. means for passing said reacted admixture to said thermal reaction chamber for stable combustion; said catalyst means being a channeled catalyst body, said channels having a flow path through which said lean admixture of fuel and air pass, said channels having a length no more than one-half the length for full boundary layer build-up in each channel up to a maximum length of 6 mm.

2. The system of claim 1 wherein said catalyst means further comprises means for electrical heating.

3. The system of claim 1 further comprising heating control means to maintain said catalyst at an effective temperature.

4. The system of claim 1 further comprising means for adding additional fuel and air to said thermal reaction chamber.

5. The system of claim 1 wherein said catalyst channels are no longer 4 mm.

* * * * *